US009689193B1

(12) United States Patent
Gulik

(10) Patent No.: US 9,689,193 B1
(45) Date of Patent: Jun. 27, 2017

(54) BOLTED SAFE MODULES MADE FROM THREE TYPES OF FORMED EDGE RAILS

(71) Applicant: Ryszard Gulik, Cocoa, FL (US)

(72) Inventor: Ryszard Gulik, Cocoa, FL (US)

( * ) Notice: Subject to any disclaimer, the term of this patent is extended or adjusted under 35 U.S.C. 154(b) by 32 days.

(21) Appl. No.: 14/963,685

(22) Filed: Dec. 9, 2015

(51) Int. Cl.
*E05G 1/024* (2006.01)
*E05D 7/14* (2006.01)

(52) U.S. Cl.
CPC ..... *E05G 1/024* (2013.01); *E05D 7/14* (2013.01); *E05Y 2800/29* (2013.01); *E05Y 2800/465* (2013.01)

(58) Field of Classification Search
CPC ..... E05G 1/024; E05G 7/14
USPC ..... 109/76–87
See application file for complete search history.

(56) References Cited

U.S. PATENT DOCUMENTS 1,054,325 A * 2/1913 Wege ..... E05G 1/024 109/74
1,404,044 A * 1/1922 Millice ..... E05G 1/024 109/74
1,666,486 A * 4/1928 Brainard ..... E05G 1/024 109/65
1,747,836 A * 2/1930 Meilink ..... E05G 1/024 109/74
2,492,422 A * 12/1949 Govan ..... E05G 1/024 109/80
4,158,338 A * 6/1979 Dippold ..... E05G 1/024 109/79
4,389,948 A * 6/1983 Sands ..... E05G 1/024 109/79
4,741,276 A * 5/1988 Pollock ..... E05G 1/024 109/25
4,918,900 A * 4/1990 Fee ..... E04C 2/528 109/80
6,418,863 B1 * 7/2002 Marks ..... B28B 19/00 109/84
6,848,372 B2 * 2/2005 Alizade ..... E05G 1/024 109/78
9,394,714 B1 * 7/2016 Willsey ..... E04H 9/14

* cited by examiner

*Primary Examiner* — Joshua Kennedy

(57) ABSTRACT

Modular elements for safe container comprising Type A, Type B, and Type C edge rails that first are formed from two different widths of flat strips and then cut to the size of each panel sides, where Type A and Type B edge rails are used to assembly the container walls, floor, and roof of the safe, and are joined together by embedded high grade carriage bolts to form the safe body, while Type C edge rails are used to assembly the door panel that is joined hingedly with the safe body and have embedded fasteners for attaching door's locking mechanism.

10 Claims, 5 Drawing Sheets

BOLTED SAFE MODULES MADE FROM THREE TYPES OF FORMED EDGE RAILS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Technical Field of the Invention

The disclosure generally relates to the modular safe panels, where five rectangular modules being three walls, floor, and roof, and with the sixth module being a door equipped with hinge, all together function as the safe container assembled with bolts.

2. Description of Related Art

Both monolithic and modular types of safes have to comply with Underwriters Laboratory Standards (No. 687) relating to burglary resistant safes. Modular safes are in disadvantage with monolithic containers due to the existence of the outside visible seams between modules bolted together, attacked by burglars with wedges or spreaders to defeat bolting connections. To prevent such mode of burglary, fasteners are strategically embedded in every panel, while innermost transitive structures in the form of perforated boxes, are used to connect matching parts. The transitive structures occupy the storage space of the safe container reducing its capacity. The steel lining, in conjunction with steel framing, is used in various configurations to determine the shape of panel and works as shells for casting concrete mixture. Modular panels, predestined to be assembled into safe container with the use of bolts, are made of sheet metal shells where the closed side is used for attachment of transitional bolting apparatus and is placed inside the safe space of the safe container. The concrete mixture is poured from open side of the shell, therefore the cast in every modular panel of the safe assembly is facing outside of the safe container. Assembly and disassembly of the transient modular safe is always performed from inside of the container.

Strength of modular safe panel is determined by the thickness and type of filament, the amount and kind of embedded reinforcement, and strategically placed fasteners. The high strength concrete mix for modern safes utilizes ceramics instead of gravel and steel fibers that, together, provide better tool and torch resistance during burglary attempt. Contact with outside surface of the module, where steel fibers in the form of needles protrude from the cast, causes severe injury. To prevent and avoid such occurrences, and also increase visual appearance of the product, outside surface of the module is usually covered with sheet metal flats or liners welded to the outside frame.

Due to the concrete mix shrinkage during curing process, the outside surface is always concaved even with the use of plasticizers reducing the amount of water in the mix. Finishing plate placed on concaved surface leaves a feeling of void underneath, and that feeling is further augmented by the heat distortion of the steel material when the finishing plates are welded with the modules. Heat distortion affects in the same extent both finishing plate and module's shell, and, as a result, increases difficulty in matching adjoining modules during the safe assembly.

Fasteners in the form of threaded inserts are embedded inside the cast of the modular panel reducing actual thickness of the secure mix to be defeated during burglary attempt, and therefore decreasing the security of the modular panel.

Shells in known art are made from sheet metal parts, welded together to form the pan in rectangular shape and to become a mold for the particular part of modular safe container. Production process of the pans includes shearing flat sheets of metal to size and shape, forming acquired blanks into parts of the pan on press-brake, and, finally, welding all formed parts together. Quality standards for sheet metal industry allow some variances in thickness, hardness, and surface smoothness. Those variances, being inherited, cause dimensional and optical inconsistencies in parts of safe module, even when blanks are derived from the same batch of sheet metal. The variable conditions existing during different stages of manufacturing process, like accuracy of the set-up of the shear and press-brake, existence of bending overflows, called knuckles, from breaking the blanks previously cut in an angle, thickness of the sheets, and type and quality of welding, all influence the shape of parts and their final quality. Assembly of parts produced in said environment requires significant amount of skilled labor to assure tight matching of the panels in the final product.

In known art of modular safes production every blank component is cut individually from standard size of sheet metal. While every individual part of the structure has different and variable dimensions by design, cutting said pieces from rectangular standard size of sheet metal causes significant material waste that increases the cost of the final product.

Modular safe, assembled from plurality of dimensionally variable elements, being the result of the manufacturing method, is burdened with inconsistent size of door frame opening. To make the safe assembly functional, modular safe door panels are made with dimensional tolerance larger than in monolith safes. More precisely, fitted door is always regarded as important security measure. Elimination of every possible dimensional variance in production process and introduction of more precise method of forming and joining panels together will result in better fitted door in modular safe assembly.

Door locking mechanism of the safe requires dedicated inserts in door surrounding modules, so the active bolts of a door locking mechanism can engage the inserts in the walls, floor, and roof to secure the door inside the door opening. The embedment of attaching inserts reduces security of that safe's locking mechanism.

Therefore, it is apparent, that there is a need for a safe, which is cost-effective and provides ability of being consistently manufactured from wide assortment of formable materials, that can be economically and easily stored, transported, installed, and relocated, that while assembled, will efficiently protects valuables in various commercial and private applications, spanning from jewelry stores to discerning individual users in high-rise building locations, for which the product can be easily customized with luxury or exotic finish without altering or affecting basic production method, that will have high ratio of useful to overall storage capacity similar to monolith type of safes, and that will have provision to utilize variety of compact and strong door locking mechanisms.

BRIEF SUMMARY OF THE INVENTION

The safe which all sides are bolted together to form a safe container is described here in preferred embodiment which meet the recognized need for customization and simplification of manufacturing, and offer cost effective solution targeting commercial applications and private consumers alike. For every predestined thickness of modular elements of the container there are only three different shapes of edge rails that are formed from two different widths of formable material of choice.

The walls, roof, and floor are made from combination of edge rails formed from wider and narrower widths, while for a door only the wider width is used. Material for edge rails can be provided by steel mill in the form of flat strip drum-rolled for the roll-forming process in continuous manner, or to be obtained by the shearing off of standard rectangular stock sheets and formed in press brake. The three types of edge rail profiles A, B, and C preformed in either process, having the shape of shiplap, are subsequently cut to size depending of type and dimensions of modular panel. The said production process allows utilizing individually manufactured parts assembled in rapid response to the demand for customized product, and eliminates the need for storing ready assembled bulky containers or even pre-manufactured flat modules.

The invention relates to the production of unconstrained sizes of the safes due to manufacturing method based on pre-formed edge rails cut to lengths. To create fill able shell or pan that becomes a casting mold ready to receive the security mix, module's frame is closed at the larger side by rectangular flat stock sheet of material, and is also predestined as the finish for the outside surface of the safe. Such construed shell of modular element equipped with reinforcement is filled with concrete mix from the smaller side of frame, and thus the sense of void is eliminated. Unfinished smaller half of the module's frame that faces the inner space of the container may be finished with the inserts of any flat material, even exotic decorative type, if desired.

The invention relates to the safe assembly, where connecting bolts are placed only in most inner and integral parts of edge rails, therefore not reducing the inner storage space of the safe. Placement of connecting bolts accommodates the use of various materials in flat sheet form for inner finish of safe, and assures that the full storage capacity of the safe is utilized.

Furthermore, the invention relates to the door panel that provides means for being equipped with desired door locking mechanism, while door module remains structurally consistent with the rest of the safe container modules. Design and type of locking mechanism depends of applied security level and is not a part of this disclosure, as multitude of designs can be easily adopted by those skilled in the art to which the invention pertains.

Also, the invention relates to the door panel hinge placement allowing the full 270 degrees door opening. Door stays tucked at the side of hinge wall of the safe providing full access to the inner space inserts i.e. set of drawers, without restricting the communication path in tight spaces, like in jewelry exchanges.

Furthermore, the invention relates to the exchangeability of the side wall modules and the symmetry of the door module, therefore the desired opening hand of the door is achieved without the need to keep inventory of both left hand and right hand type of safe containers with the adequate doors.

BRIEF DESCRIPTION OF THE DRAWINGS

Descriptions of drawings for the presently disclosed preferable modular safe embodiment provide consistent reference with numerals denoting similar elements throughout, including parts, cross sections, and isometric views of referenced fragments.

Drawings are provided solely for the purpose of illustration and they are not intended to limit disclosure to any or all of the exact details of the invention shown, except being essential to explain structural functionality and claimed disclosure.

DETAILED DESCRIPTION

Use of actual terminology to describe exemplary and preferable embodiment of the present disclosure, as illustrated in FIGS. 1-18, is not intended to exclude any, or other technical terminology or limit processes, or shapes to describe similar products, which may lead to the accomplishment of similar function, and is limited only by the listed claims.

Figure 1:
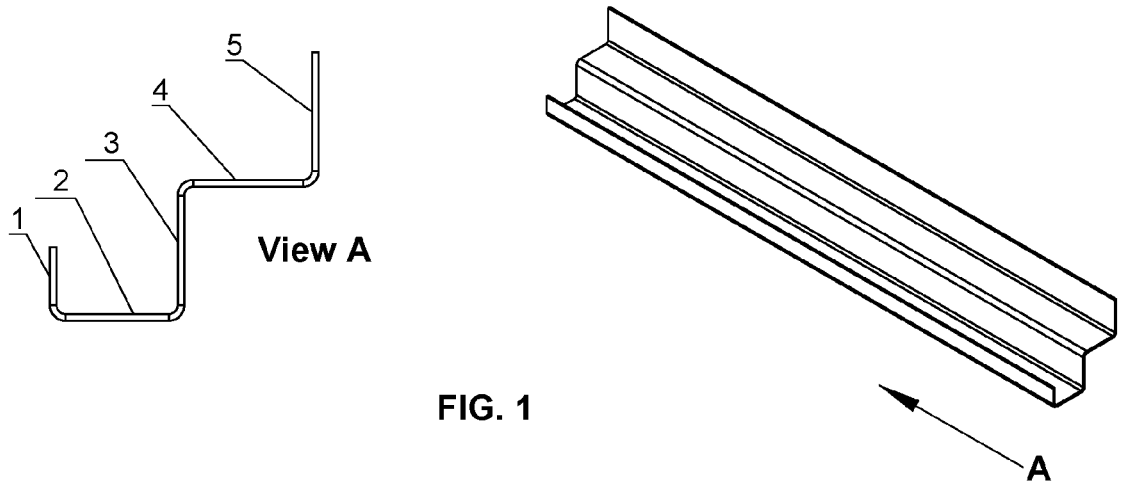
FIG. 1 shows the end view of the edge rail Type A profile.
Figure 2:
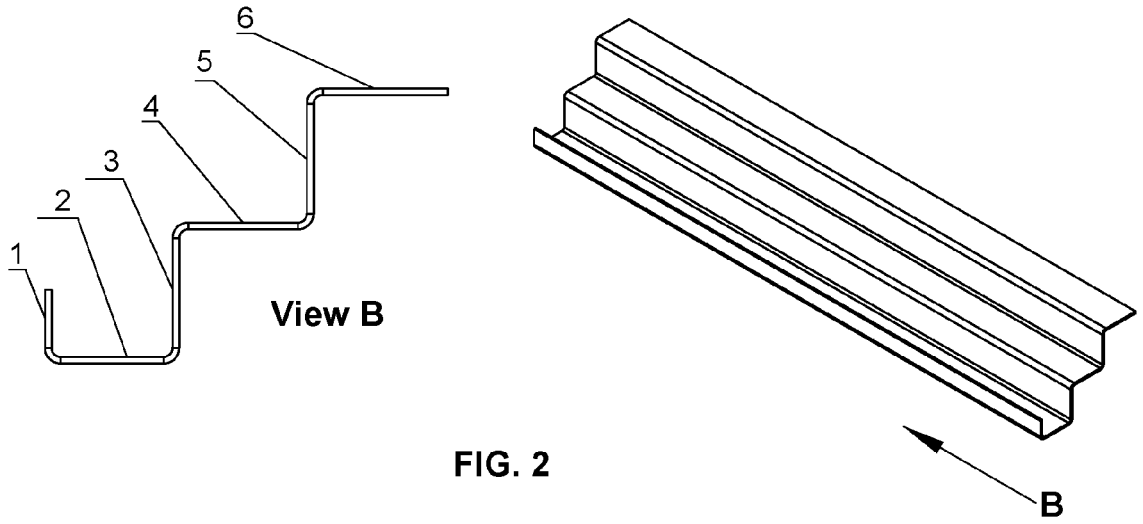
FIG. 2 shows the end view of the edge rail Type B profile.

Referring to FIG. 1, example embodiment of the edge rail Type A profile consists of plurality of perpendicular walls which were obtained in forming process and here are called bends that are numbered from 1 to 5. Bends 2, 3, 4, and 5 for every type of the edge rail in disclosed application have the same length, where the distance between each pair of parallel bends is equal to the half of the resultant modular panel thickness, while distance between bend 1 and bend 5 determines the full thickness of the panel. Bend 1 is smaller than the remaining bends to accommodate tooling used to form the said bend. For roll-formed application the length of bend 1 is determined by the width allowance for the first roller, while for press-breaking application bend 1 is determined by the shape and size of the goose neck die, and in both applications bend 1 is shorter than the second bend to avoid the tool interference. Inner space contained between the three bends 1, 2, and 3, in either method, is formed consequently in the same up-direction.

Figure 3:
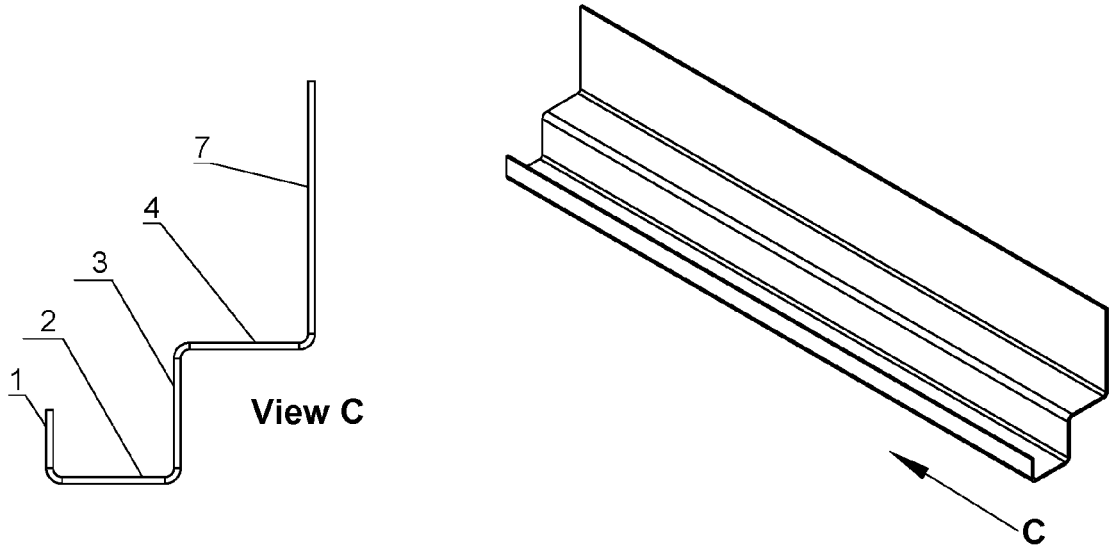
FIG. 3 shows the end view of the edge rail Type C profile.

The example embodiment of the edge rail Type B profile on FIG. 3 shows plurality of perpendicular bends numbered from 1 to 6. Bends 2, 3, 4, 5, and 6 have the same length where the distance between each pair of parallel bends is equal the half of the resultant modular panel thickness, while distance between bend 1 and bend 5 determines the full thickness of the panel, similarly like in edge rail Type A.

Figure 5:
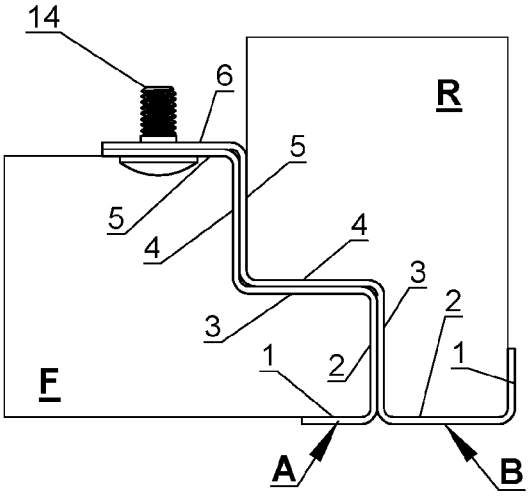
FIG. 5 shows interacting profiles of the edge rails Type A and Type B to illustrate the relation between the modular panels of floor F and back wall R.

Referring to FIG. 5, example embodiment of the edge rail Type C profile shows plurality of perpendicular walls numbered 1, 2, 3, 4, and 7. Bends 2, 3, and 4 have the same length and the distance between each pair of parallel bends are equal to the half of the resultant modular panel thickness. The distance between bend 1 and bend 7 determines the full thickness of the panel. Length of bend 7 is equal to the double length of any other bend 2, 3 or 4 except bend 1 that is smaller than the remaining bends to accommodate tooling used to form the shape. Summing up:

for every thickness of the modular panel all bends 1, in every type of edge rail, are equal and smaller then the next bends, also all bends 2, 3, 4, 5, and 6 are equal, while the bend 7 has the length of any two equal bends from 2 to 6 combined together.

Width of material blank in the form of flat or drum-rolled strip is the same for Types B and Type C profiles. Width of material blank for Type A profile is shorter by the length of any one bend from 2 to 6. In another way, the width of material blanks for Type B and Type C profiles are 5 times the half of the modular panel thickness plus the length of bend 1, while for Type A profile the width of material blank is 4 times the half of the modular panel thickness plus the length of bend 1.

Characteristics of all modular panels are identical throughout the body of text in description of preferable embodiment of the present disclosure, and all are denoted with underscored letters derived from the destination in the safe assembly where F being a floor, R being a rear wall, T being a top, O being an open side wall, H being a hinge side wall, and D being a door.

Figure 4:
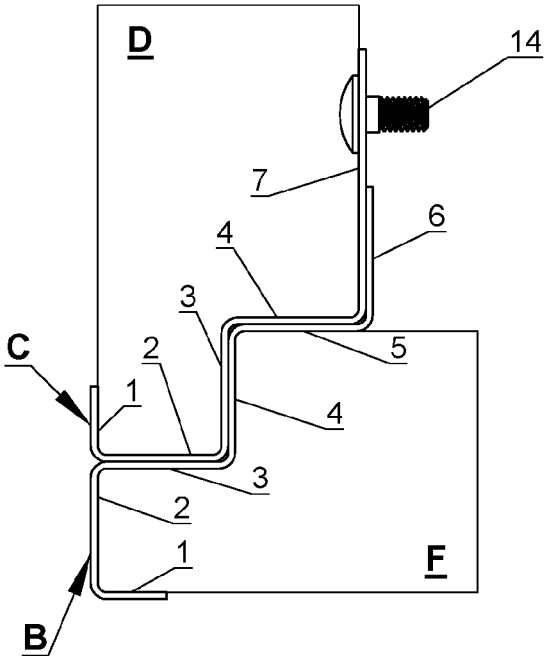
FIG. 4 shows interacting profiles of the edge rails Type B and Type C to illustrate the relation between the modular panels of door D and floor F.

FIG. 4 shows relation of two interconnected edge rails of floor panel F with Type B profile, and the edge rail of door panel D with Type C profile. Connecting bolts placed in Type C profile are not interfering with edge rail Type B profile in the assembly. Bolt inserts 14 placed in square perforations of the edge rail Type C are provided for attaching the locking mechanism's plate of which round perforations have to match.

FIG. 5 illustrates relation of two interconnected edge rails of floor panel F with Type A profile, and the edge rail of rear wall panel R with Type B profile. Edge rail Type A always has square perforations in bend 5 matching the size of under head parts of high grade carriage type bolts inserts 14. Edge rail Type B has round perforations in bend 6 except when placed in door opening where the perforations are absent. All square perforations of edge rails Type A correspond with the round perforations of edge rails Type B.

Figure 6:
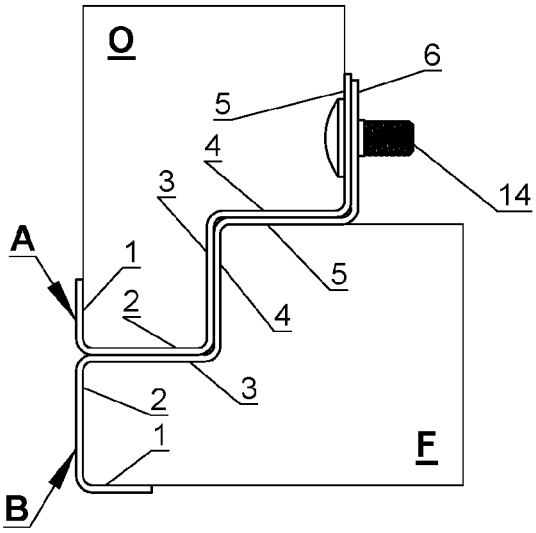
FIG. 6 shows interacting profiles of the edge rails Type A and Type B to illustrate the relation between the modular panels of floor F and side wall O.

FIG. 6 illustrates the relation of two interconnected edge rails of floor panel F with Type B profile, and the edge rail of open side wall panel O with Type A profile. Square perforations in the bend 5 of edge rail Type A accommodate the insertion of high grade carriage type bolts 14, and round perforations in bend 6 of edge rail Type B correspond with square perforations in bend 5 of edge rail Type A.

Figure 7:
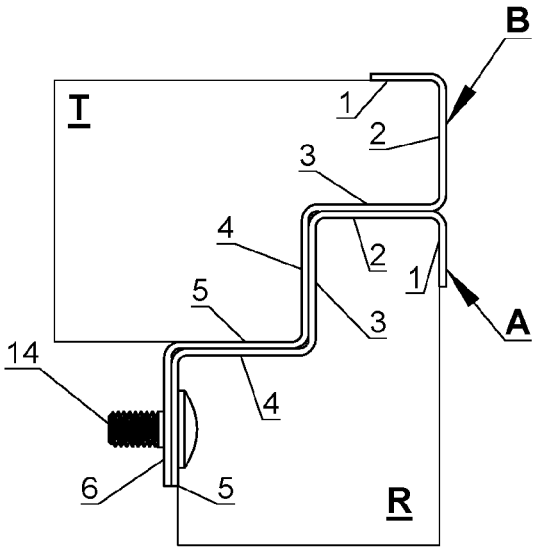
FIG. 7 shows interacting profiles of the edge rails Type A and Type B to illustrate the relation between the modular panels of roof T and back wall R.

FIG. 7 shows the relation of two interconnected edge rails of rear wall panel R with Type A profile, and the edge rail of top panel T with Type B profile. Square perforations in the bend 5 of edge rail Type A accommodate the insertion of high grade carriage type bolts 14, and round perforations in bend 6 of edge rail Type B correspond with square perforations in bend 5 of edge rail Type A.

The matrix of the perforations in the edge rails is established in relation to type and thickness of material from which said edge rail is formed. Thicker material of the edge rail requires smaller number but also larger size of the bolts and consequently longer distance between the bolts. The security of the container depends of modular panel's thickness, type of filament, size, type, and pattern of connecting bolts. The final guidance in this matter should always be supported by the positive result of test carried by The Underwriters Laboratory.

Figure 8:
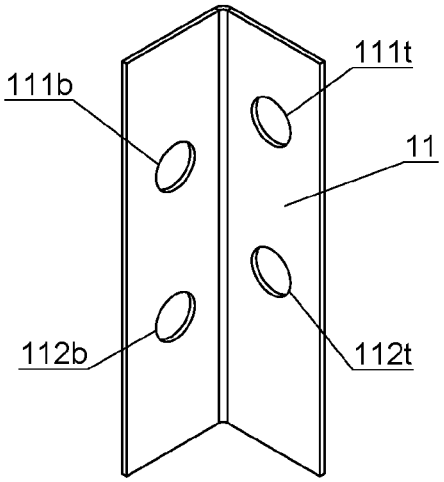
FIG. 8 shows stand-up bracket for placement and assembly of rebar grids.

FIG. 8 shows an isometric view of the stand-up bracket in the form of an angle bar with perforations which dimensions are adequate to the size of the rebar, while the bracket's height being not longer than the final thickness of the cast. In preferred embodiment of present disclosure the stand-up bracket 11 has two levels of perforations where the pair of perforations on one level are marked as 111*t* and 111*b* and are vertically offset by the diameter of the rebar rod to allow the perpendicular placement in cross joint of the two rebar rods. Perforations, marked as 112*b* and 112*t* on the other level, are made in a distance from the first pair and also enable an assembly of the cross joint of other two rebar rods. The multitude of stand-up brackets is used to form the rebar grid. The pair of perforations 112*t* and 112*b*, situated closer to the outside surface of the shell, constructs and supports the larger rebar grid. The pair of perforations 111*t* and 111*b*, situated farther from the outside surface of the shell, constructs and supports the smaller rebar grid. Perforations on each level of the stand-up bracket are offset by the spacing distance for the rebar grids and secure their positions inside the shell. The lower pair of perforations 112*b* and 112*t* establishes outside rebar grid location at approximately ¼ of the modular panel's thickness, while the pair of top perforations 111*b* and 111*t* places the inside rebar grid at approximately ¾ of the modular panel's thickness, measured from the outside finishing plate 8 that is the bottom of the shell. Number of perforation pairs in one stand-up bracket relates to the number of rebar grids layers. Stand-up brackets 11, while randomly placed inside the shell, allow to assembly the layers of rebar grids without using wire ties or welding. Said method of assembly effectively secures the positions and spacing of the rebar grids from the bottom of the shell during casting process.

Figure 9:
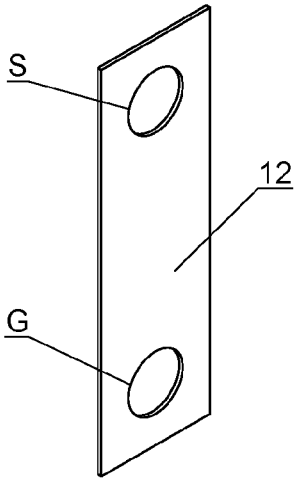
FIG. 9 shows rebar grid hanger.

Rebar grid hanger in FIG. 9 secures and connects the set of rebar grids assembly with the shell. Rebar grid hanger in the form of flat strip has two perforations, where the size of perforation G is adequate to the size of the rebar rods used in rebar grid, while the size of perforation S matches the size of perforations in edge rail Type B. The hanger connects edge rail with rebar grid eliminating welding process, prevents heat distortion of the edge rail, and allows the use of variety of formable but non-weld able materials. Due to the innermost location of perforations in the edge rails of Type B, the said connection between the rebar grid, and body of the modular panel efficiently defeats burglary attempt.

Figure 10:
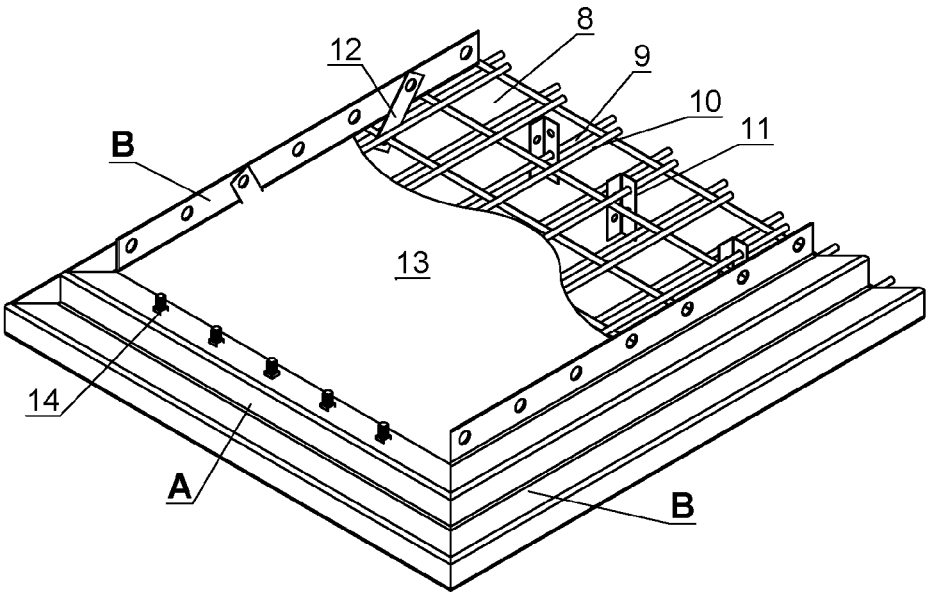
FIG. 10 shows assembly of the typical modular panel with one edge rail removed for better view of structural elements and indicates the exemplary combination of edge rail types used in the assembly.

Assembly in FIG. 10 represents the exemplary structure of typical modular panel consisting mixture of the edge rails Type A and Type B. One edge rail and the partial section of the concrete mix is removed for better illustration of structural elements placement inside the shell. Edge rail Type A is always equipped with bolts 14, while perforated edge rails Type B are interacting with the hangers 12. Frame consisting of edge rails Type A and Type B is closed at the wider side with flat stock sheet 8 of choice for finishing material. The frame, together with flat stock sheet 8, becomes a shell of the mold. Lower cage 9 made of rebar, which size is determined by the security concern and thickness of the modular panel, is supported and spaced from the finishing plate by the stand-up brackets 11 that in exemplary disclosure are shown in FIG. 8 in the form of an angle bar with perforations. Higher rebar grid 10 is also supported and spaced from the lower rebar grid 9 by using the second row of the perforations in the same stand-up brackets 11. Top rebar grid is randomly connected by hangers 12 with the perforated edge rails Type B. Such assembled shell constitutes the mold for modular panel and can be filled with the high security concrete mix.

Figure 11:
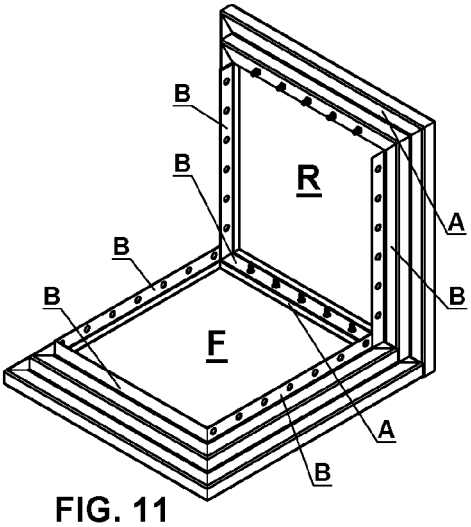
FIG. 11-15 shows sequence of the safe's modules assembly and types of edge rails location in consecutive modular panels.

FIGS. 11-15 show the sequence of secure container assembly consisting only the frames of adequate modular panels to better illustrate the relational dependency of the safe modules. Washers and acorn type nuts used for assembly are also omitted for the same reason of clearer illustration of the assembly process. FIG. 11 shows floor F connected with rear wall R, where square perforations in edge rail Type A of the floor F equipped with bolt inserts 14 match round perforations of edge rail Type B in the rear wall R. The same configurations are present and true in every connection, where always edge rails Type A interact with edge rails Type B. Also, edge rails Type A have always square perforations for bolt inserts 14, while edge rails Type B have round perforations to match the bolt inserts in edge rails Type A.

Figure 12:
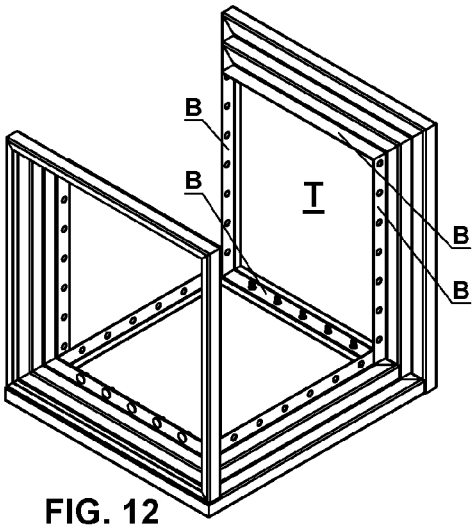
Figure 13:
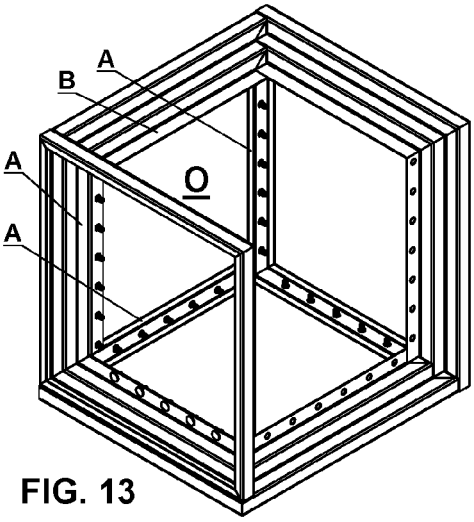
Figure 14:
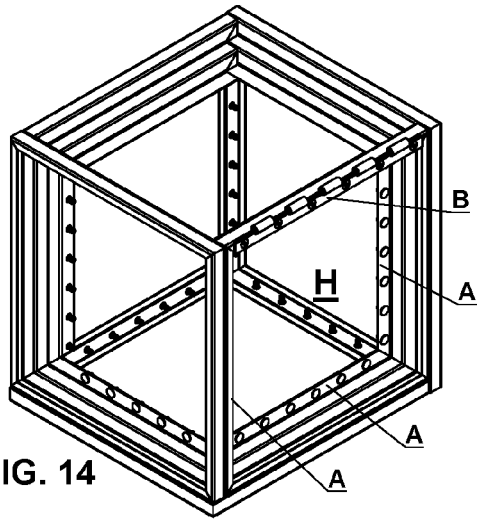
Figure 15:
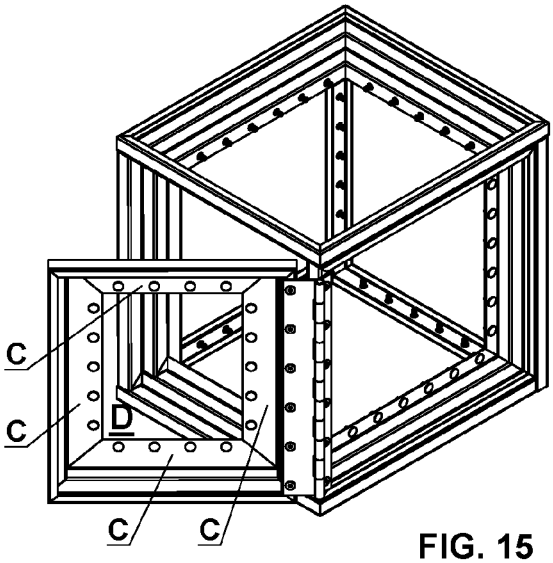

FIG. 12 shows secure and most effective assembly of the safe container, where the rear wall R is placed on the flat surface and is used as the base for the assembly. By adding consecutive parts illustrated in FIG. 13 and FIG. 14, the assembly of the safe body is finished with the door opening placed on the top of the assembly. Edge rail types used for assembly of every consecutively added panel are indicated. When all panels are in place, while the rear wall is used as the base for the assembly, all connections and adjustments are easily made before the container is placed on its floor for final inspection and presentation as shown in FIG. 15.

Figure 16:
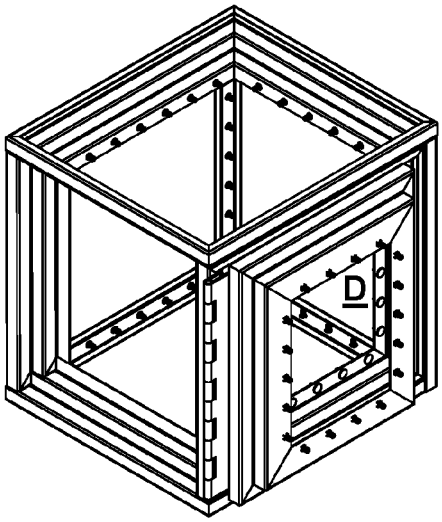
FIG. 16 shows the door panel in fully opened position.

FIG. 16 shows the ability of the safe's door to swing ¾ of the full turn and to remain tacked to the side of safe, so it does not restrict the movement around the safe in confined location, and allows full access to the safe's inner space. Clearly visible plain edge rails Type B of walls, top, and floor modules that enclose the door opening, provide ledges for interaction with active elements of door locking mechanism. Placement of the ledges in the door opening of the container render redundant inserts inside the side walls, floor or roof in door opening.

Figure 17:
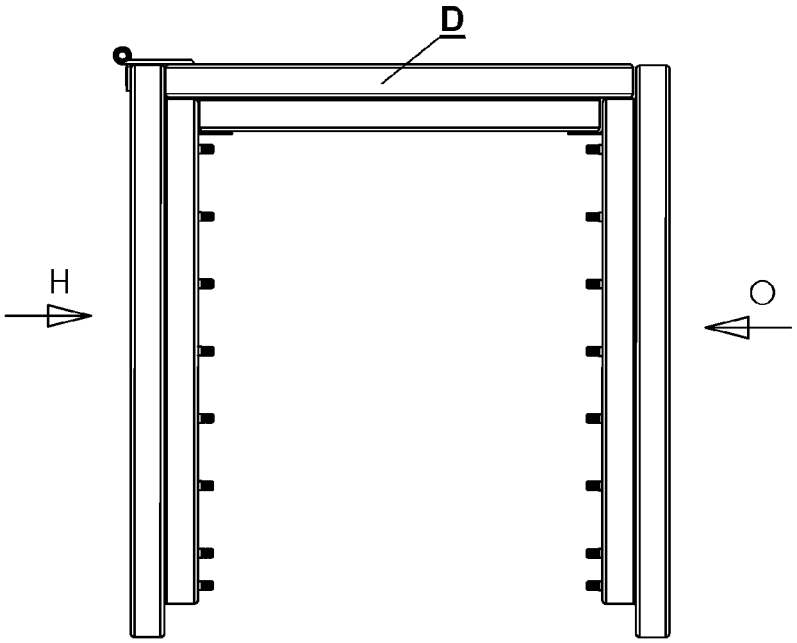
FIG. 17 shows the assembly of hinge side wall H, open side wall O and the door D in top view.
Figure 18:
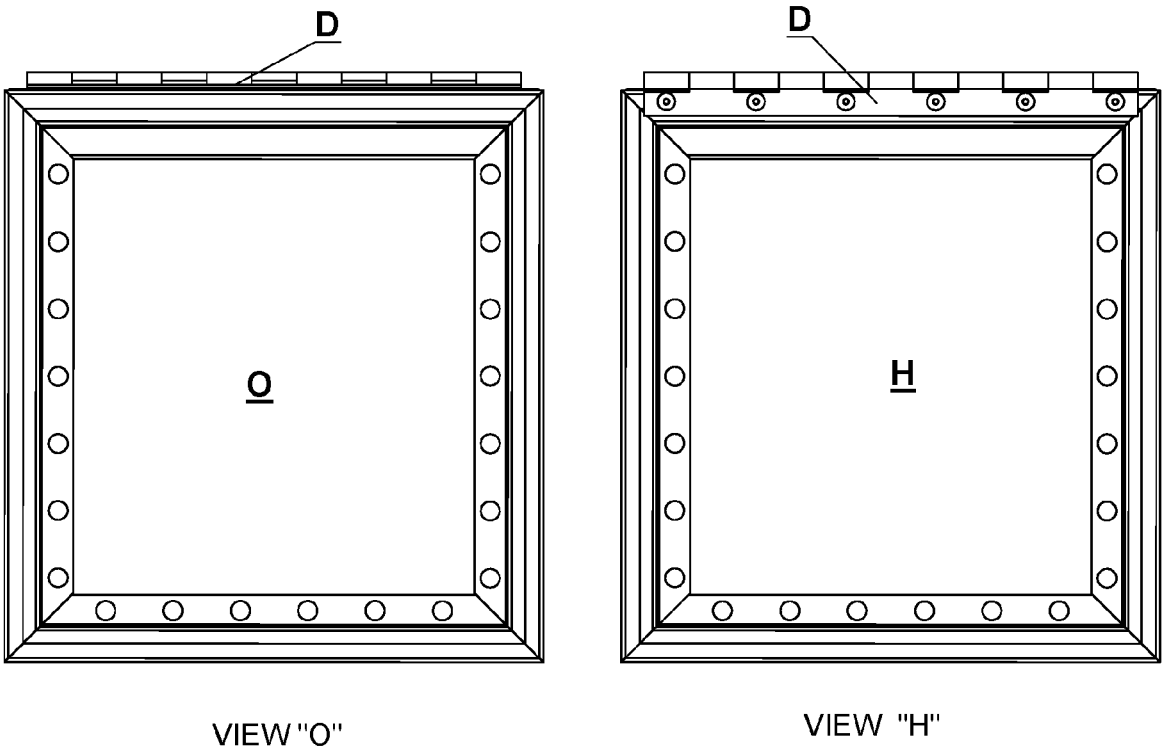
FIG. 18 illustrates two views of the walls from either side of door O or H allowing their exchangeability in the choice of door opening hand.

FIG. 17 shows in top view the partial assembly of the hinge side wall panel H with the door D and the open side wall O to illustrate exchangeability of door hand opening. FIG. 18 shows that positions and type of perforations in the edge rails of the open side wall O in view "O", and the edge rails of the hinge side wall H in view "H" are identical and symmetrical. The said symmetry applies also to the hinge assembly and to the door frame of the door D as it shows also on FIG. 15. The said proficiency eliminates the need to make predestined hand door opening and decreases the variety and the number of parts in the production.

Based on description of my invention, I claim:

1. A modular safe of panel construction comprising:

three types of edge rails, each comprising a plurality of perpendicular walls, called bends:

Type A edge rails having five bends, a first bend being shorter in width than a remaining four bends that are equal in width;

Type B edge rails having six bends, a first bend being shorter in width than a remaining five bends that are equal in width;

Type C edge rails having five bends, two bends being different than a remaining three bends that are equal in length, such that a first of the two different bends is shorter in width and the second of the two different bends is equal the two of any equal bends of edge rail Type A and/or Type B;

the first bend and the second of the next two consecutive bends of each edge rail extends in the same direction so as to define an inner space;

each of the Type B and Type C edge rails are formed from the same overall width of a profile strip, while the edge rail Type A is formed from a profile strip narrower than the profile strip for edge rail Type B or Type C by the distance between the closest parallel bends in any of said edge rails;

each of the edge rails are primarily formed from one of two widths of flat stock in roll-forming or press-braking process, and afterward cut from a full length of formed rail to a predefined length;

a plurality of Type A and Type B edge rails assembled to form a rectangular frame of the modular panel safe, the thickness of the frame being determined by double the distance between a pair of closest parallel bends of the plurality of Type A and Type B edge rails;

wherein a plurality of the rectangular frames are assembled to define a container having walls, a floor, and a roof of the modular safe;

each of the edge rails of the container, respectively, has perforations in peripheral bends farthest from the first bend that is smaller than the remaining bends, and the perforations are square in Type A and Type C edge rails, and round in Type B edge rails, where the square perforations match the size of under head parts of high grade carriage bolts to prevent bolts' rotation during assembly process, and position the bolts to protrude outside of the frame perpendicularly to the smaller first bend of Type A edge rails;

the square perforations of one edge rail match the round perforations in an adjacent frame to facilitate the container assembly; and a door frame comprises four Type C edge rails assembled into a frame with the square perforations located adjacent to the peripheral edge of the longest bend in the said edge rail, and high grade carriage bolt inserts are placed in the square perforations of the Type C edge rails and determine the positions of round perforations in a base plate for attachment of a locking mechanism.

2. The modular safe of claim 1, further comprising a heavy duty piano hinge having symmetrically placed knuckles along the length of a pair of hinge leaves, where a hinge leaf attached to the door frame is wider than a hinge leaf attached to a frame of hinge side wall by the half of the frame's thickness where; the hinge leaves are attached by bolts to the edge rail of hinge side wall frame and to the adjacent edge rail of the door frame through perforations that are made in the first bends Type C edge rails for the door and Type B edge rails for the side wall, therefore the said hinge leaves allow the use of door frame in the left hand or the right hand configuration, and to be opened at ¾ of the full rotation.

3. The modular safe of claim 1, wherein each frame defines openings: a smaller opening at one planar side, and a larger opening on an opposite planar side, wherein the larger opening is closed by a finishing plate, wherein each frame in combination with a respective finishing plate constitutes a shell of modular panels.

4. The modular safe of claim 3, wherein the shell allows casting of a concrete mix through the smaller opening of each frame of the shell to form a modular panel that, while assembled into the safe container structure, has a finished planar face placed outside, and an unfinished planar face placed inside the container.

5. The modular safe of claim 3, wherein the shell comprises a plurality of stand-up brackets that are placed inside the shell to space away, connect, and support layers of rebar grid during casting process, and are in the form of an angle bar that has two perforation levels, each perforation matching a gauge size of rebar, and each level is accommodating two rebar on the same level placed perpendicularly to each other, where perforations on a same side of the stand-up bracket are offset by spacing distance between the rebar grids, while perforations on the same stand-up bracket level are offset by the distance equal the gauge size of the rebar, therefore each stand-up bracket holds multitude of rebar pairs inside the shell perpendicularly and in close proximity of each other, and facilitates assembly of the rebar rods into the rebar grid inside the shell without welding or using ties.

6. The modular safe of claim 5, wherein each of the stand-up brackets hold an outer rebar grid at the ¼ of the shell thickness, and the inner rebar grid at the ¾ of the shell thickness.

7. The modular safe of claim 5, wherein the number of perforation levels in each the stand-up brackets is variable to meet security requirements related to the number of grid layers and their positioning inside the shell.

8. The modular safe of claim 5, wherein the rebar grids formed by the stand-up brackets are attached to the body of the shell by the plurality of hangers in the form of flat metal strips with two perforations, each hanger comprising: a top perforation and a bottom perforation, of which size is adequate with the gauge size of rebar, where the top perforation corresponds with the perforation in the edge rail Type B, and the bottom perforation matches location of the rod in rebar grid, therefore said hangers utilize the existing bolting system of the modular safe structure to connect the rebar grid layers with the body of the shell during casting process, and are placed inside the safe space of the container structure assuring safety of the connection.

9. The modular safe of claim 3, wherein all fasteners are located inside a safe space of the container along the seams between adjoining frame/panel modules therefore assuring the unconstrained secure space inside the container and form the container with the high ratio of useful to overall storage capacity.

10. The modular safe of claim 9 accommodates the use of various materials, including decorative type in flat sheet form, for inner finish of safe without decreasing the useful storage capacity of the safe.

* * * * *